United States Patent [19]

Scheying

[11] 4,250,859

[45] Feb. 17, 1981

[54] ADJUSTING MECHANISM FOR THE ROTATIONAL SPEED-DEPENDENT CONTROL OF THE INJECTION INSTANT OF AN INJECTION PUMP OF INTERNAL COMBUSTION ENGINES

[75] Inventor: Heinz Scheying, Stuttgart, Fed. Rep. of Germany

[73] Assignee: Daimler-Benz Aktiengesellschaft, Fed. Rep. of Germany

[21] Appl. No.: 915,138

[22] Filed: Jun. 13, 1978

[30] Foreign Application Priority Data

Jun. 16, 1977 [DE] Fed. Rep. of Germany ..... 2727121

[51] Int. Cl.[3] ..... F02M 59/20

[52] U.S. Cl. ..... 123/501; 64/25; 200/31 CA

[58] Field of Search ..... 64/25; 200/31 R, 31 A, 200/31 CA; 123/146.5 A, 146.5 R, 139 AP

[56] References Cited

U.S. PATENT DOCUMENTS

| | | | |
|---|---|---|---|
| 1,105,628 | 8/1914 | Diemer | 64/25 |
| 3,008,313 | 11/1961 | Mehlitz | 64/25 |
| 3,455,286 | 7/1969 | Reisacher | 123/139 AP |
| 3,728,870 | 4/1973 | Vuaille | 64/25 |
| 3,834,184 | 10/1974 | Hoffman | 123/139 AP |
| 3,942,492 | 3/1976 | Iguchi | 200/31 CA |

FOREIGN PATENT DOCUMENTS

| | | | |
|---|---|---|---|
| 1196220 | 6/1970 | United Kingdom | 123/139 AP |

*Primary Examiner*—Ira S. Lazarus
*Assistant Examiner*—Magdalen Moy
*Attorney, Agent, or Firm*—Craig & Antonelli

[57] ABSTRACT

An adjusting mechanism for the rotational speed-dependent control of the injection instant of an injection pump of internal combustion engines, with a primary part driven by the crankshaft and with a secondary part rotatably connected with the pump shaft and with the return springs supported, on the one hand, at guide members of the primary part and, on the other, at guide members of the secondary part; the return springs, with increasing rotational speed of the adjusting mechanism, act opposite the flyweights guided between the guide members; within the lower rotational speed range, at least one return spring which is disposed opposite at least another return spring installed under prestress, has a play between the guide members between which it is supported.

5 Claims, 2 Drawing Figures

Figure 1:
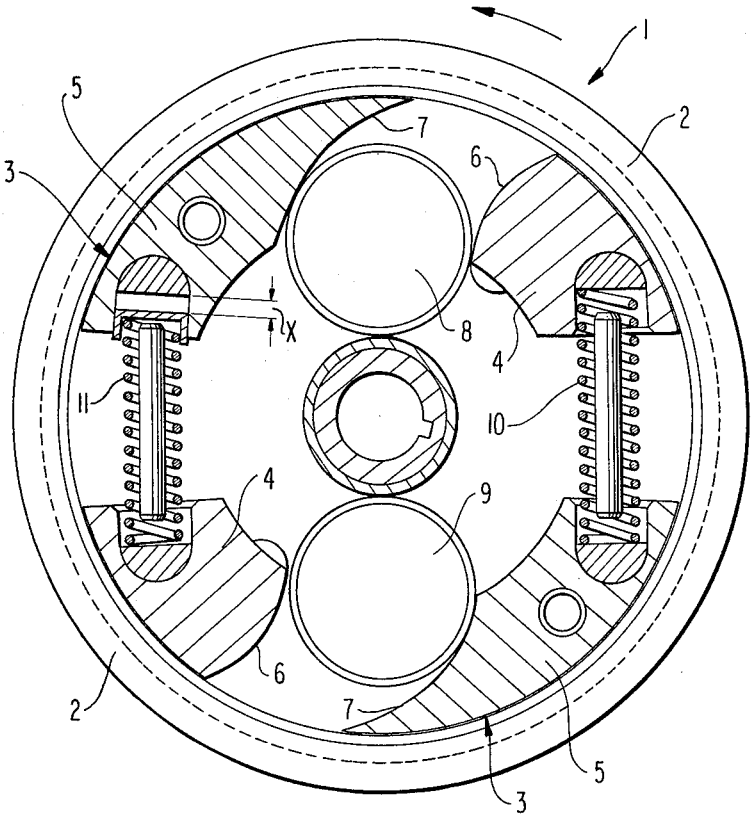

ADJUSTING MECHANISM FOR THE ROTATIONAL SPEED-DEPENDENT CONTROL OF THE INJECTION INSTANT OF AN INJECTION PUMP OF INTERNAL COMBUSTION ENGINES

The present invention relates to an adjusting mechanism for the rotational speed-dependent control of the injection instant of an injection pump of internal combustion engines, especially of air-compressing injection internal combustion engines, with a primary part driven by a crankshaft and with a secondary part rigidly connected with a pump shaft and with return springs supported, on the one hand, at guide members of the primary part and, on the other, at guide members of the secondary part, which with an increasing rotational speed of the adjusting mechanism counteract flyweights guided between the guide members.

With prior art adjusting mechanisms of the aforementioned type, the adjusting angle of the secondary part becomes larger with an increasing rotational speed as a result of the radially and/or tangentially outwardly forced flyweights due to the construction of the mutually opposite cam-like slide surfaces or slide tracks of the guide members. The injection beginning adjustment, which has been attained heretofore, however, results in an adjusting characteristic which deviates or moves away from a characteristic required by the engine in the lower and upper load range.

The present invention is concerned with the task to eliminate this disadvantage.

The underlying problems are solved according to the present invention in that at least one return spring which is disposed opposite at least another return spring installed under prestress has a play or clearance between the guide members within the lower rotational speed range of the adjusting mechanism.

As a result of this spring arrangement, a rapidly responding adjustment of the injection beginning is achieved with an increase of the engine rotational speed out of the lower rotational speed range or with rotational speed changes within this rotational speed range because the spring installed with clearance or play becomes effective only later on.

In a preferred embodiment of the present invention, the return springs may be arranged shortly in front of the housing inner wall of the primary part in the cross-sectional plane of the adjusting mechanism perpendicularly to the radial direction in order to obtain as large a lever arm as possible.

Accordingly, it is an object of the present invention to provide an adjusting mechanism for a rotational speed-dependent control of the injection instant of an injection pump of internal combustion engines, which avoids by simple means the aforementioned shortcomings and drawbacks encountered in the prior art.

Another object of the present invention resides in an adjusting mechanism for the rotational speed-dependent control of the injection instant of an injection pump of internal combustion engines which provides an adjustment characteristic more closely matched to the desired characteristics of the engine in all of the load ranges including the lower and upper load range.

A further object of the present invention resides in an adjusting mechanism for an injection pump of internal combustion engines of the type described above, which assures a rapidly responding adjustment of the beginning of the injection with an increase of the rotational speed of the engine out of the lower rotational speed range or during rotational speed changes within this rotational speed range, without adversely affecting the desired operation in the upper load range.

Still a further object of the present invention resides in an adjusting mechanism of the type described above which is simple in construction, utilizes relatively few parts that can be easily manufactured and installed, and is highly reliable in its operation.

Figure 2:
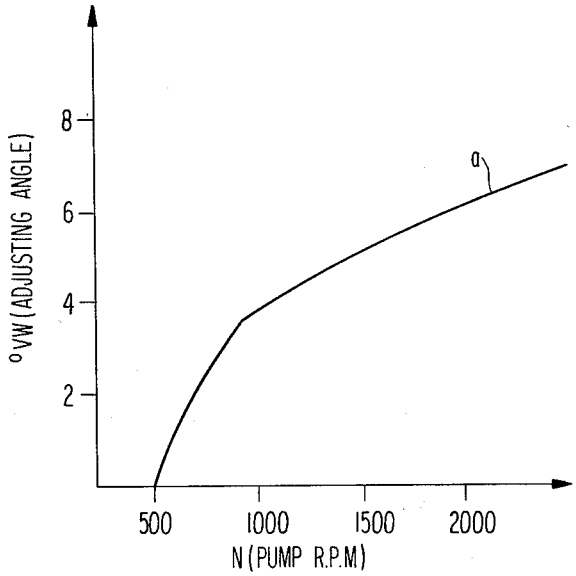

These and other objects, features and advantages of the present invention will become more apparent from the following description when taken in connection with the accompanying drawing which shows, for purposes of illustration only, one embodiment in accordance with the present invention, and wherein:

FIG. 1 is a cross-sectional view through an adjusting mechanism in accordance with the present invention for controlling the injection instant of an injection pump of an internal combustion engine; and FIG. 2 is a diagram with a curve, in which the adjusting angle is plotted against pump rotational speed.

Referring now to the drawing, and more particularly to FIG. 1, an adjusting mechanism generally designated by reference numeral 1 which is illustrated in cross section in this figure, essentially consists of a primary part 2 driven by the crankshaft of an internal combustion engine (not shown) and of a secondary part generally designated by reference numeral 3 rigidly connected with the pump shaft of the injection pump.

The primary part 2 and the secondary part 3 are each provided with two projecting guide members 4 and 5 respectively, of which the guide members 4 of the primary part 2 as also the guide members 5 of the secondary part 3 are disposed diametrally opposite one another.

The guide members 4 and 5 are provided with respective curved guide surfaces 6 and 7 directed in the same direction, whereby these guide surfaces consist of circular arcs that do not have the same center point.

Roller-shaped flyweights 8 and 9 glide along these guide surfaces 6 and 7, which flyweights are forced outwardly with an increasing rotational speed by reason of the centrifugal force effect and which adjust the secondary part 3 with respect to the primary part 2 by a few angular degrees against the force of two return springs 10 and 11 arranged between the secondary part 3 and the primary part 2 and therewith change correspondingly the injection instant.

The return spring 10 is installed with prestress whereas, in contrast thereto, the return spring 11 is installed without prestress and more particularly with the clearance or play "X". This position is illustrated in FIG. 1. Additionally, the return springs 10 and 11 are so placed in the adjusting mechanism that they extend shortly up to the outer circumference of the guide members 4 and 5 and are arranged perpendicularly to the radial direction in the cross-sectional plane of the adjusting mechanism.

Due to the fact that the second return spring 11 becomes effective later, a curve shape or operating behavior results, as is characterized in FIG. 2, for example, by the curve "a" of the injection beginning. Beginning with the point of the bend of this curve, also the return spring 11 acts opposite the flyweights 7 and 8.

While I have shown and described only one embodiment in accordance with the present invention, it is understood that the same is not limited thereto but is susceptible of numerous changes and modifications as known to those skilled in the art, and I therefore do not wish to be limited to the details shown and described herein but intend to cover all such changes and modifications as are encompassed by the scope of the appended claims.

I claim:

1. An adjusting mechanism for the rotational speed-dependent control of the injection instant of an injection pump of internal combustion engines, comprising a primary member operable to be driven by a crankshaft and a secondary member operable to be drivingly connected with the pump shaft, guide means for the primary part and guide means for the secondary part, flyweight means guided between respective guide means, and return spring means supported at the guide means of the primary part and at the guide means of the secondary part which with increasing rotational speed of the adjusting mechanism counteract the flyweight means, characterized in that within the lower rotational speed range of the adjusting mechanism a clearance is provided between an end of at least one return spring means and a guide means of the secondary part whereby a more rapidly responding adjustment is achieved within a lower rotational speed range of the adjusting mechanism.

2. An adjusting mechanism according to claim 1, characterized in that said at least one return spring means is disposed substantially opposite at least another return spring means installed with prestress.

3. An adjusting mechanism according to claim 1 or 2, characterized in that the return spring means are arranged proximate a housing inner wall of the primary part in a cross-sectional plane of the adjusting mechanism perpendicular to the radial direction.

4. An adjusting mechanism according to claim 3, characterized in that the internal combustion engine is an air-compressing injection internal combustion engine.

5. An adjusting mechanism according to claim 1, characterized in that said primary part guide means and said secondary part guide means have curved guide surfaces in the same direction defined by circular arcs not having the same center points.

* * * * *